US006946801B2

(12) United States Patent
Kitahara

(10) Patent No.: US 6,946,801 B2
(45) Date of Patent: Sep. 20, 2005

(54) ORGANIC EL ELEMENT DRIVE CIRCUIT AND ORGANIC EL DISPLAY DEVICE

(75) Inventor: Shinji Kitahara, Kyoto (JP)

(73) Assignee: Rohm Co. Ltd., Kyoto (JP)

( * ) Notice: Subject to any disclaimer, the term of this patent is extended or adjusted under 35 U.S.C. 154(b) by 55 days.

(21) Appl. No.: 10/414,154

(22) Filed: Apr. 16, 2003

(65) Prior Publication Data

US 2003/0197473 A1 Oct. 23, 2003

(30) Foreign Application Priority Data

Apr. 23, 2002 (JP) ..... 2002-120128

(51) Int. Cl.[7] ..... G09G 3/10; G09G 3/36

(52) U.S. Cl. ..... 315/169.3; 315/169.1; 345/98; 345/76; 345/104; 345/214

(58) Field of Search ..... 315/169.3, 169.1, 315/169.2; 345/98, 102, 104, 76, 207, 208, 211, 214

(56) References Cited

U.S. PATENT DOCUMENTS 6,147,665 A * 11/2000 Friedman ..... 345/75.2

6,586,888 B2 * 7/2003 Kitahara et al. ..... 315/169.1

FOREIGN PATENT DOCUMENTS

| | | |
|---|---|---|
| JP | 10-112391 | 4/1998 |
| JP | 2003-234655 | 8/2003 |

* cited by examiner

*Primary Examiner*—Tuyet Thi Vo
(74) *Attorney, Agent, or Firm*—Mattingly, Stanger & Malur, P.C.

(57) ABSTRACT

A current mirror circuit of a current output circuit for current-driving an organic EL display panel is constructed with a plurality (n) of unit circuits each including a first MOS transistor of a certain channel type and a second MOS transistor of the same channel type having a source connected to a drain of the first MOS transistor, where n is an integer equal to or larger than 3, in which gates of the first MOS transistors or the second MOS transistors of at least two of the plurality of the unit circuits are connected to each other to form a common gate, one of the at least two unit circuits constitutes an input side circuit of the current mirror circuit, the other unit circuit constitutes an output side of the current mirror circuit.

12 Claims, 3 Drawing Sheets

ORGANIC EL ELEMENT DRIVE CIRCUIT AND ORGANIC EL DISPLAY DEVICE

BACKGROUND OF THE INVENTION

1. Field of the Invention

The present invention relates to an organic EL element drive circuit and an organic EL display device using the same and, in particular, the present invention relates to an improvement of an organic EL element drive circuit for a column line (one of anode side drive lines of an organic EL panel), with which, when the organic EL element drive circuit is formed as an IC, freedom of a wiring and a layout thereof is increased, an area of the organic EL element drive circuit can be reduced and power consumption thereof can be reduced, and an organic EL display device using the same organic EL element drive circuit.

2. Description of the Prior Art

It has been known that an organic EL display device, which realizes a high luminance display by spontaneous light emission, is suitable for a display on a small display screen and the organic EL display device has been attracting public attention as the next generation display device to be mounted on a portable telephone set, a PHS, a DVD player or a PDA (Personal Digital Assistants), etc. Known problems of the organic EL display device are that, when it is driven by voltage as in a liquid crystal display device, luminance variation thereof becomes substantial and that, since there is difference in sensitivity between R (red), G (green) and B (blue), a control of luminance of a color display becomes difficult. In view of these problems, an organic EL display device using current drive circuits has been proposed recently. For example, JPH10-112391A discloses a technique with which the luminance variation problem is solved by employing a current drive system.

An organic EL display panel of an organic EL display device for a portable telephone set, a PHS, etc., having 396 (=132×3) terminal pins for column lines and 162 terminal pins for row lines has been proposed. However, there is a tendency that the number of column lines as well as row lines is further increased.

An output stage of a current drive circuit of such organic EL display panel of either the active matrix type or the simple matrix type includes a current source drive circuit, such as an output circuit constructed with a current mirror circuit, for each of the terminal pins. A drive stage thereof includes a parallel-driven type current mirror circuit (reference circuit distribution circuit) having a plurality of output side transistors for each of the terminal pins as disclosed in JP2002-82662 (domestic priority application claiming priorities of JP2001-86967 and JP2001-396219) corresponding to U.S. patent application Ser. No. 10,102,671. In the disclosed drive stage, a plurality of mirror currents are generated correspondingly to the respective terminal pins by a reference current supplied from a reference current generator circuit to thereby drive the output circuits and by supplying them to the respective pins. Alternatively, the mirror currents supplied to the respective terminal pins are amplified by respective k-time current amplifier circuits, where k is an integer equal to or larger than 2, and the output circuits are driven with the amplified currents. The k-time amplifier circuit is disclosed in JP2002-33719, in which D/A converter circuits are provided correspondingly to the respective terminal pins and the D/A converter circuit converts display data corresponding to the column side terminal pins into analog data to generate column side drive currents simultaneously.

In this disclosed circuit construction, a peak current is generated for initially charging an organic EL element having capacitive load characteristics to drive the organic EL element. The peak current may be generated in a circuit portion preceding to the drive stage as a reference current, in a circuit portion succeeding to a D/A converter circuit as disclosed in JP2002-33719 or in a current output stage.

FIG. 3 shows a technique disclosed in U.S. patent application Ser. No. 10,360,715 corresponding to JP2002-33937 and assigned to the present assignee, in which a peak current generator circuit is provided in a D/A converter circuit.

In FIG. 3, a column driver of an organic EL element drive circuit includes a drive current generator circuit 10 for generating a drive current corresponding to a display data, a D/A converter circuit 11 provided in the drive current generator circuit 10, a constant current source 12 for supplying a current having value Ip, a current mirror type current output circuit 13, a peak current generator circuit 14, a control circuit 15 and a register 16.

The D/A converter circuit 11 includes an N channel input side transistor TNa and an N channel input side transistor TNp mirror-connected to the N channel input side transistor TNa. The D/A converter circuit 11 further includes N channel output side transistors TNb to TNn−1, which are current-mirror connected to the input side transistors TNa and TNp.

Channel width (gate width) ratio of the transistors TNa to TNb is set to 1:9. A source of the transistor TNa is grounded through a resistor Ra and a source of the transistor TNp is grounded through a resistor Rpa and a switch circuit SWpa. For the sake of simplicity of description, a switch SWa provided between the resistor Ra and ground GND, which is shown in FIG. 1 of U.S. patent application Ser. No. 10,360,715, is not shown in FIG. 3.

The channel width (gate width) ratio of 1:9 may be obtained by parallel-connecting 9 of 10 MOS transistors having identical configurations and good pairing characteristics to the remaining one MOS transistor.

The input side transistors TNa and TNp are connected to an input terminal 11*a* and supplied with the current Ip from the constant current source 12 through the input terminal 11*a*.

When the current having the value Ip flows in the input side transistor TNa as an operating current, a peak current Ia (=Ipa) corresponding to a display data is generated at an output terminal lib of the D/A converter circuit 11. When the current Ip is branched and flows in the input side transistors TNa and TNp, an input side drive current of the current mirror circuit becomes substantially one-tenth the current Ip and a drive current Ia (=Ipa/10) corresponding to the display data is generated at the output terminal 11*b* of the D/A converter circuit 11.

Resistors Rb to Rn−1 are provided between sources of the output side transistors TNb to TNn−1 and drains of transistors Trb to Trn−1, respectively. With these resistors, it is possible to improve preciseness of the current pairing characteristics of the D/A converter circuit 11.

Gates of the transistors Trb to Trn−1 are connected to input terminals Do to Dn−1 to which n-bit display data are inputted. Thus, the transistors Trb to Trn−1 are supplied with the display data from the register 16. Sources of the transistors Trb to Trn−1 are grounded.

The current mirror type current output circuit 13 includes a drive level shifter circuit 13*a* and an output stage current mirror circuit 13*b*.

The drive level shifter circuit 13*a* functions to transmit the output of the D/A converter circuit 11 to the output stage current mirror circuit 13*b* and includes an N channel MOS FET TNv. A gate of the transistor TNv is connected to a bias line Vb and a source of the same transistor is connected to the output terminal 11*b* of the D/A converter circuit 11. A drain of the transistor TNv is connected to an input terminal 13*c* of the output stage current mirror circuit 13*b*.

Therefore, assuming that the output current of the D/A converter circuit 11 is Ia, it is possible to generate a drive current of Ia at the input terminal 13*c*.

The output stage current mirror circuit 13*b* includes a current mirror circuit composed of P channel MOS FETs TPu and TPw for correcting a gate drive voltage and P channel MOS FETs TPx and TPy, which are driven by the transistors TPu and TPw. Gate width ratio of the transistor TPx to the transistor TPy of the output stage current mirror circuit 13*b* is 1:N. Sources of the transistors TPx and TPy are connected to not a power source line +VDD but a power source line +Vcc which is higher than +VDD, for example, about +15V. The transistor TPy is connected to a column side terminal pin 9 and drives the terminal pin 9 by supplying drive current N Ia. An organic El element 8 is connected between the terminal pin 9 and ground GND. Incidentally, Vc in FIG. 3 is also a bias line.

The input side transistor TNp, the resistor Rpa and the switch circuit SWpa constitute the peak current generator circuit 14 and the switch circuit SWpa is turned OFF for a constant time period tp in an initial stage of driving without a control signal CONT from the control circuit 15 and is turned ON by the control signal CONT after the time period tp lapses.

Since the switch circuit SWpa does not receive the control signal CONT from the control circuit 15 in the initial driving stage, the current Ip flows in the input side transistor TNa. Therefore, a current, which is several times, for example, M times, the current Ip, corresponding to the display data set in the respective input terminals D0 to Dn−1, that is, M×Ip (=Ipa), is generated, so that the peak current Ia=M×Ip is generated at the output terminal 11*b* of the D/A converter circuit 11. The control signal CONT is generated after the peak current generating period tp and the switch circuit SWpa is turned ON. The current in the input side transistor TNa is branched to the input side transistor TNp. Therefore, a drive current, which is Ip/10, flows in the input side transistor TNa and a drive current 9×Ip/10 flows in the input side transistor TNp according to the gate width ratio 1:9 of these transistors. As a result, the input side drive current of the current mirror circuit becomes substantially 1/10 and the current Ia(=Ipa/10) is generated at the output terminal 11*b* of the D/A converter circuit 11.

There is a recent tendency that the number of drive pins is increasing due to request of high resolution. Correspondingly to the increase of the drive terminal pins, the number of the output stages of the current drive circuit tends to be increased. Therefore, power consumption is increased correspondingly, so that a reduction of power of the current drive circuit becomes necessary. In order to solve this problem, the current drive circuit constructed with MOS transistors, such as shown in FIG. 3, has been proposed. In such output stage constructed with these MOS transistors (current mirror type current output circuit 13), the drive circuit composed of the MOS transistors and the current mirror output circuit composed of the MOS transistors and connected in series with the drive circuit are connected to the higher voltage power source line.

When the current drive circuit composed of the MOS transistors is used, various currents for operating the circuit, such as bias currents and currents required to correct the base current, etc., are necessary as in the case where a current drive circuit composed of bipolar transistors and a leak current problem occurs. These currents are increased with increase of the number of terminal pins and an influence of these currents on power consumption of the whole circuit becomes large correspondingly, resulting in an obstacle in reducing the power consumption.

Further, in the current drive circuit shown in FIG. 3, the circuit constructions of the D/A converter circuit 11, the peak current generator circuit provided in the D/A converter circuit 11 and the output stage composed of the MOS transistors are different. Such current drive circuit must be designed by determining layouts and wiring of the respective circuits. Therefore, the efficiency of layout is low and the freedom of wiring is low. For this reason, it becomes relatively difficult to reduce the size of circuit.

SUMMARY OF THE INVENTION

An object of the present invention is to provide an organic EL element drive circuit with which the freedom in designing a layout and a wiring of a current drive circuit can be increased, an area occupied thereby can be reduced and power consumption thereof can be reduced, when a plurality of the organic EL element drive circuits are fabricated as an IC.

Another object of the present invention is to provide an organic EL display device utilizing a plurality of organic EL element drive circuits with which the freedom in designing a layout and a wiring of a current drive circuit is increased, an area occupied thereby can be reduced and power consumption thereof can be reduced, when a plurality of the organic EL element drive circuits are fabricated as ICs.

In order to achieve these objects, an organic EL element drive circuit for current-driving any one of organic EL elements of an organic EL display panel by an output current supplied from a current output circuit constructed with a current-mirror circuit through a corresponding terminal pin of the panel, according to the present invention, is featured by comprising a plurality (n) of unit circuits each including a first MOS transistor of a certain channel type and a second MOS transistor of the same channel type and having a source connected to a drain of the first MOS transistor, where n is an integer equal to or larger than 3. Gates of either the first MOS transistors or the second MOS transistors of at least two of the n unit circuits are connected together to form a common gate. One of the two unit circuits constitutes an input side unit circuit of the output stage current mirror circuit, the other of the two unit circuit constitutes an output side circuit of the current mirror type output stage circuit. The common gate is connected to a current drive side terminal of the input side unit circuit through either the first MOS transistor or the second MOS transistor of another unit circuit as a drive side unit circuit.

In an embodiment of the present invention, the unit circuit is constructed by connecting a drain of a P or N channel type first MOS transistor to a source of a second MOS transistor having the same channel type and a plurality of the unit circuits are formed in an IC chip. By selectively wiring these unit circuits on the IC chip, the current mirror circuit of the output stage of the organic EL element drive circuit can be constructed.

The input side unit circuit as well as the output side unit circuit of the output stage current mirror circuit includes two MOS transistors connected in series with each other. Therefore, by turning the MOS transistors of one of the two unit circuits, which are other than the MOS transistors having the common gates, ON and turning the MOS transistors of the unit circuit, which have the common gates and connect the current drive side terminal of the input side unit circuit to the common gates, ON, a general current mirror circuit having a diode-connected input side circuit is realized.

Since, with such circuit construction, the MOS transistor of the output side unit circuit, which are the MOS transistors having no common gate, can be turned OFF in a period during which the drive current from the drive side unit circuit is not outputted, unnecessary current does not flow from the output side unit circuit to other unit circuits connected thereto. Particularly, by constructing each unit circuit with a pair of series-connected P channel type MOS transistors and by turning an upstream one of the MOS transistors, which is the MOS transistor having no common gate, ON to generate the drive current, unnecessary current does not flow in the downstream side transistor during a time in which the upstream side transistor is in OFF state. Further, since the output stage current mirror circuit is driven after at least one of the MOS transistors of the other unit circuit, which connects the common gates to the current drive side terminal of the input side unit circuit, is turned ON, there is substantially no leak current.

Therefore, in the output stage current mirror circuit constructed with the above mentioned identical unit circuits, there is substantially no current such as bias current for drive, current for correcting the base current and leak current, etc., in a period in which the terminal pin is not current-driven.

As a result, the unit circuits are fabricated as an IC, the freedom of layout and wiring is increased. Further, it is possible to realize an organic EL element drive circuit and an organic EL display device capable of reducing an area occupied by the current drive circuits and of reducing power consumption.

DETAILED DESCRIPTION OF THE PREFERRED EMBODIMENTS

Figure 1:
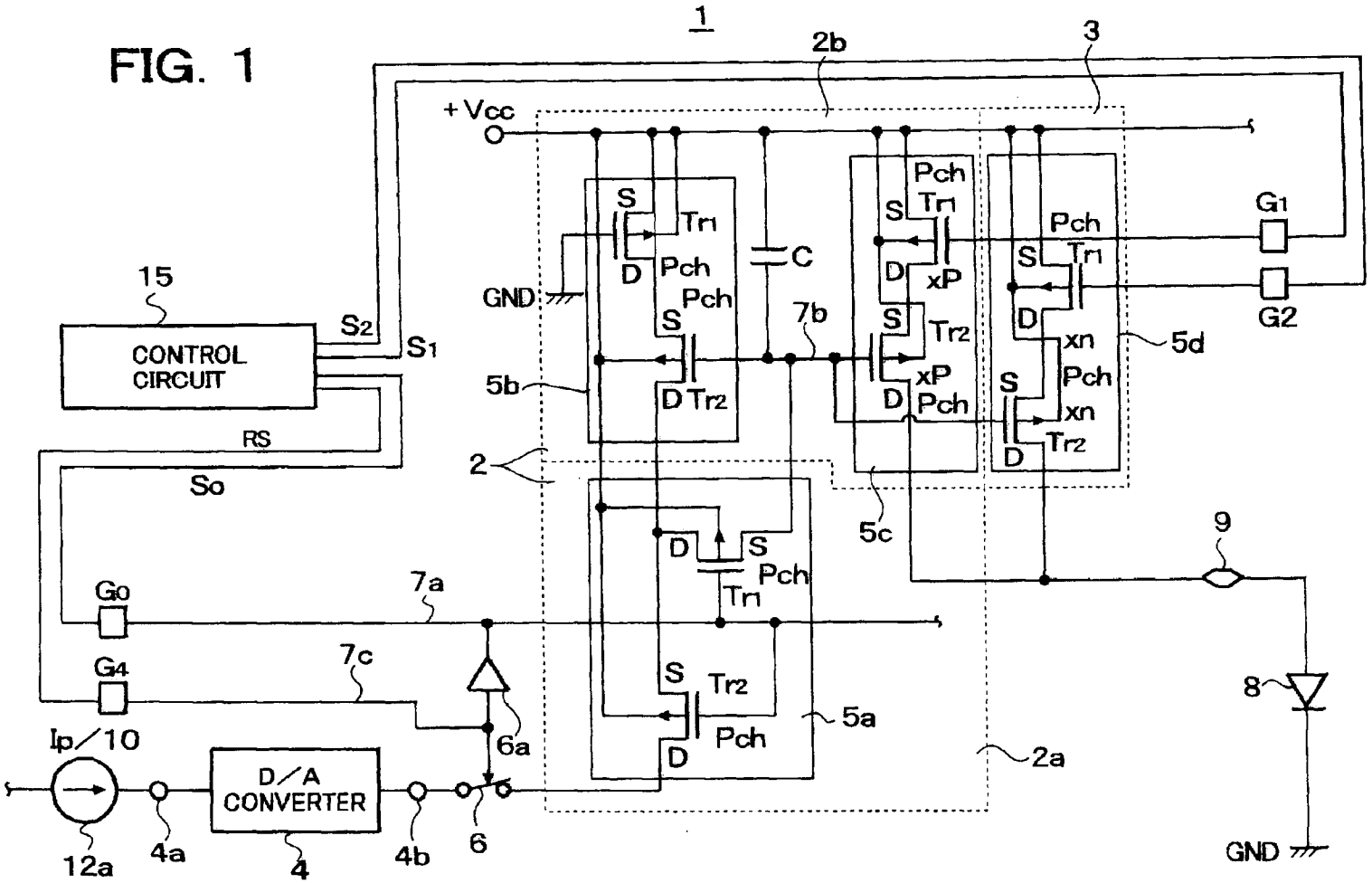
FIG. 1 is a block circuit diagram of an organic EL element drive circuit according to an embodiment of the present invention.

FIG. 1 is a block circuit diagram of an organic EL element drive circuit 1 for a column driver, according to an embodiment of the present invention. The organic EL element drive circuit 1 shown in FIG. 1 includes a current-mirror type current output circuit 2, a peak current generator circuit 3 and a D/A converter 4, which corresponds to a D/A converter 11 shown in FIG. 3 except that a peak current generator circuit 14 of the D/A converter 11 is removed.

Figure 3:
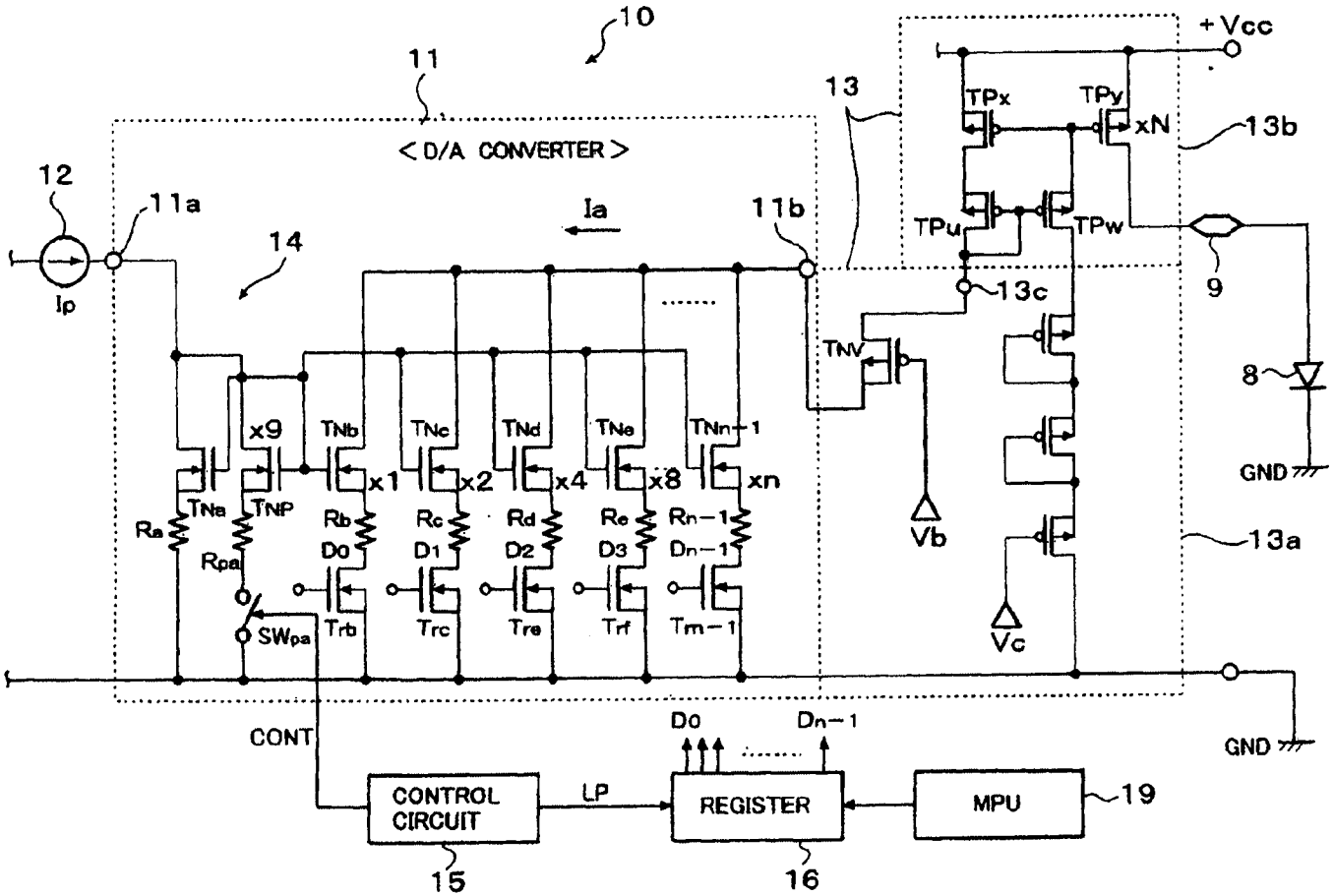
FIG. 3 (PRIOR ART)
FIG. 3 is a circuit diagram of a conventional organic EL element drive circuit.

Therefore, the D/A converter 4 includes a transistor corresponding to an input side transistor TNa of the D/A converter 11 in FIG. 3 and a transistor corresponding to a transistor TNp of the D/A converter 11 is removed. The transistor corresponding to the transistor TNa of the D/A converter 11 has an input terminal 4*a* supplied with a current, which is one-tenth a current Ip corresponding to a peak current, from a constant current source 12*a*. Although not shown, the D/A converter 4 includes output side transistors corresponding to output side transistors TNb to TNn−1 of the D/A converter 11 and a sum of currents outputted from these output side transistors is outputted from an output terminal 4*b* corresponding to an output terminal 11*b* of the D/A converter 11.

The current-mirror type current output circuit 2 corresponds to the current mirror type current output circuit 13 shown in FIG. 3 and is constructed with a drive circuit 2*a* and an output stage current mirror circuit 2*b*. The drive circuit 2*a* is provided as a unit circuit 5*a* including a P channel MOS transistor Tr1 and a P channel MOS transistor Tr2 connected in series with the transistor Tr1. The output stage current mirror circuit 2*b* includes an input side unit circuit 5*b* having a circuit construction identical to that of the unit circuit 5*a* and an output side unit circuit 5*c*.

By constituting the output stage current mirror circuit 2 with the unit circuits 5*a* and 5*b* and the output side unit circuit 5*c*, the reduction of power consumption and the freedom of the layout and wiring design are realized. Incidentally, back gates of the transistors Tr1 and Tr2 of the unit circuits 5*a* and 5*b* are connected to a common power source line Vcc.

Describing the drive circuit 2*a* first, the unit circuit 5*a* constituting the drive circuit 2*a* is constructed with the P channel MOS transistors Tr1 and Tr2 as mentioned above. That is, a drain of the transistor Tr1 is connected to a source of the transistor Tr2 and the drain of the transistor Tr2 is connected to the output terminal 4*b* of the D/A converter 4 through a switch circuit 6. Gates of the transistors Tr1 and Tr2 are connected to a control terminal Go supplied with a control signal So from a control circuit 15 through a control line 7*a*.

The input side unit circuit 5*b* of the output stage current mirror circuit 2*b* is constructed with the P channel MOS transistors Tr1 and Tr2 as mentioned above. A source of the transistor Tr1 of the input side unit circuit 5*b* is connected to the power source line +Vcc and a drain of the transistor Tr2 thereof is connected to the drain of the transistor Tr1 of the unit circuit 5*a* of the drive circuit 2*a* and driven by a drive current outputted from the drive circuit 2*a*.

A gate of the transistor Tr1 of the input side unit circuit 5*b* is grounded. Therefore, the transistor Tr1 of the unit circuit 5*b* is normally in ON state with a predetermined impedance. Although, in this embodiment, the gate of the transistor Tr1 is grounded, the gate thereof may be connected to a bias line for biasing the transistor to ON state with a predetermined ON impedance.

With using the transistor Tr1 of the unit circuit 5*b*, which has the predetermined ON impedance, the input side unit circuit 5*b* can be constructed by using a unit circuit, which is identical to the output side unit circuit 5*c* of the output stage current mirror circuit 2*b*. Therefore, the operation level thereof can be matched with that of the output side unit circuit 5*c*.

The output side unit circuit 5*c* of the output stage current mirror circuit 2*b* can be constructed with a plurality (p) of parallel-connected unit circuits each being identical to the input side unit circuit 5*b*, where p is an integer equal to or larger than 2. Sources of p transistors Tr1 of the output side unit circuit are connected to the power source line +Vcc and drains of p transistors Tr2 thereof are connected to a terminal pin 9. Gates of the p transistors Tr1 are commonly connected to a control terminal G1 to which a control signal S1 is supplied from the control circuit 15. In this case, it may be possible to form p unit circuits by connecting the drains of the parallel-connected p transistors Tr1 to the sources of the parallel-connected p transistors Tr2, respectively. The gate of the transistor Tr2 of the input side unit circuit 5*b* of the output stage current mirror circuit 2*b* and the gates of the transistors Tr2 of the output side unit circuit 5*c* thereof are commonly connected to a gate connecting line 7*b* and a capacitor C is provided between the gate connecting line 7*b* and the power source line +Vcc. Further, the source of the transistor Tr1 of the unit circuit 5*a* of the drive circuit 2*a* is connected to the gate connecting line 7*b,* so that the gate of the transistor Tr1 of the unit circuit 5*a* constituting the drive circuit 2*a* and the gates of the transistors Tr2 of the output stage current mirror circuit 2*b* are driven by a voltage across the capacitor C.

The source of the transistor Tr1 of the unit circuit 5*a* of the drive circuit 2*a* is connected to the gate connecting line 7*b* and the drain thereof is connected to the drain of the transistor Tr2 of the input side unit circuit 5*b* of the output stage current mirror circuit 2*b.* Therefore, when the transistor Tr1 of the drive circuit 2*a* is turned ON, the transistor Tr2 of the input side unit circuit 5*b* is diode-connected, so that the input side unit circuit 5*b* and the output side unit circuit 5*c* operate as a current mirror circuit.

The peak current generator circuit 3 includes a plurality (n) of parallel-connected unit circuits each including transistors Tr1 and Tr2, where n is an integer larger than p. In the peak current generator circuit 3, sources of the n transistors Tr1 are connected to the power source line +Vcc and drains of the n transistors Tr2 are connected to the terminal pin 9. Gates of the n transistors Tr1 are commonly connected to a control terminal G2 to which a control signal S2 is supplied from the control circuit 15. In this case, it may be also possible to constitute the peak current generator circuit 3 by connecting drains of the parallel-connected p transistors Tr1 to sources of parallel-connected p transistors Tr2, respectively.

A terminal G4 of the organic EL element drive circuit receives a low (L) level reset signal RS from the control circuit 15. The switch 6 is turned OFF by the L level reset signal RS supplied thereto through a control line 7*c*. The L level reset signal is also supplied to the control line 7*a* through a buffer amplifier 6*a* to turn the transistor Tr1 of the unit circuit 5*a* constituting the drive circuit 2*a* ON. Therefore, the capacitor C is discharged through the transistor Tr1 thus turned ON and the transistors Tr1 and Tr2 of the input side unit circuit 5*b,* which are in ON states, to thereby the voltage of the capacitor C is reset.

The transistor Tr1 of the unit circuit 5*a* of the drive circuit 2*a* can be turned ON by turning the switch circuit 6 OFF with the reset signal RS supplied to the terminal G4 and simultaneously setting the control line 7*a* to L level.

Now, an operation of the current mirror type current output circuit 2 will be described with reference to FIG. 2. It is assumed here that L levels of the control signals So to S2 and the reset signal RS are significant and it is assumed that a drive voltage for current mirror operation is temporarily stored in the capacitor C and an actual current outputting operation is performed according to a generation timing of the control signals S1 and S2.

Figure 2:
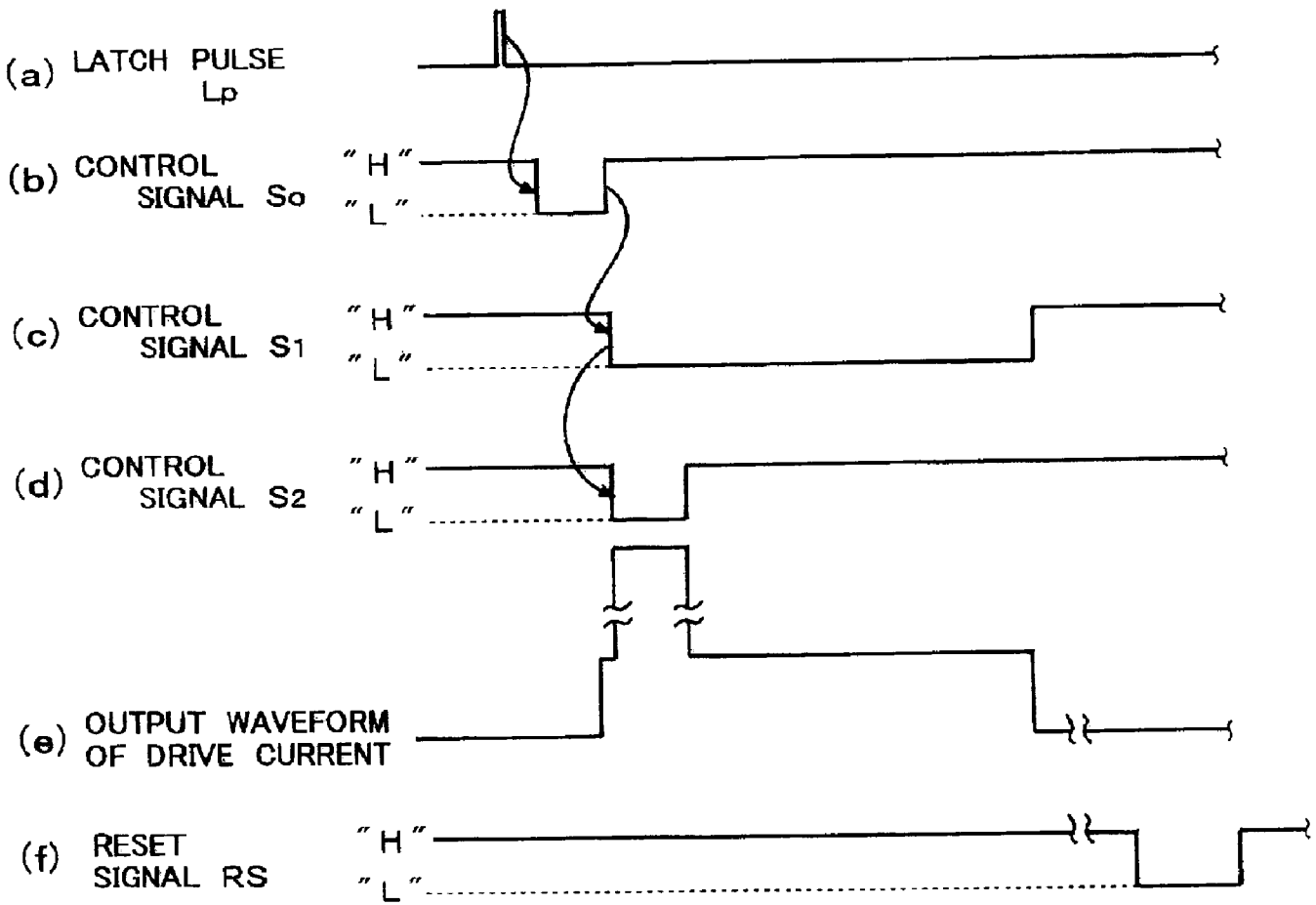
FIG. 2 illustrates waveforms of various control signals used in the embodiment shown in FIG. 1.

Display data is set in the D/A converter 4, first, and then set in the register 16, shown in FIG. 3 according to a latch pulse Lp shown in FIG. 2(*a*). Thereafter, as shown in FIG. 2(*b*), the control signal So in L level is generated for a constant time to make the control line Go L level. During the constant time in which the control signal So is in L level, the transistors Tr1 and Tr2 of the drive circuit 2*a* are in ON state, so that the gate line 7*b* is driven by a drive current corresponding to the display data to charge the capacitor C to a predetermined voltage level. The switch circuit 6 is normally in ON state by a high (H) level reset signal RS.

In this case, the transistors Tr2 of the input side unit circuit 5*b* and the output side unit circuit 5*c* become ON by the voltage of the capacitor C. However, the control signals S1 and S2 supplied to the respective control terminals G1 and G2 are H level and the gates of the transistors Tr1 of the output side unit circuit 5*c* and the peak current generator circuit 3 become H level. Therefore, these transistors Tr1 are kept OFF. As a result, no current is supplied to the terminal pin 9.

Thereafter, when the control signal S1 becomes L level at a time when the control line Go becomes H level as shown in FIG. 2(*c*), the transistors Tr1 of the output side unit circuit 5*c* become ON and a current is supplied to the terminal pin 9 through the transistors Tr2 of the output side unit circuit 5*c,* which are ON according to the voltage of the capacitor C. When the control signal S2 becomes L level as shown in FIG. 2(*d*), the transistors Tr1 of the peak current generator circuit 3 become ON and a further current is supplied to the terminal pin 9 through the transistors Tr2 of the peak current generator circuit 3, which are kept in ON state by the voltage of the capacitor C.

As a result, a drive current having a peak such as shown in FIG. 2(*e*) is generated in the terminal pin 9 during the period in which the control signals S1 and S2 are in L level and the organic EL element 8 is current-driven thereby. In this case, ineffective current does not flow in the output side unit circuit 5*c* of the output stage current mirror circuit 2*b* so long as the transistors Tr1 thereof are in OFF states. Further, since the transistors Tr1 and Tr2 of the unit circuit 5*a* of the drive circuit 2*a,* which are turned ON by the control signal So, function to allow a drive current for charging the capacitor C to flow, substantially no drive current such as leak current flows when these transistors are OFF.

The timing of the control signal S2 with respect to the control signal S1 is not limited to the described timing. It may be any, provided that the peak current for initially charging the organic EL element 8 having the capacitive characteristics can be generated.

The reset signal RS shown in FIG. 2(*f*) is generated with such a timing that the voltage of the capacitor C is reset before a drive of a next column line is started.

Although the control signals So to S2 and the reset signal RS have been described as L level significant, they can be H level significant when these signals are supplied through inverters.

Although the peak current generator circuit 3 is constructed as the unit circuit 5*d* including the transistors Tr1 and the transistors Tr2, it is not always necessary to construct the peak current-generator circuit 3 with the unit circuit. Further, the peak current generator circuit 3 is not always provided in parallel to the output stage current mirror circuit. The D/A converter 4 may be replaced by the D/A converter 11 including the peak current generator circuit 14, which is shown in FIG. 3.

Further, although the capacitor C is provided to temporarily store the drive current of the current mirror output circuit and then the drive current is outputted to the terminal pin according to the control signal, the capacitor C may be removed to directly output the terminal pin drive current. In such case, since the output side unit circuit 5*c* includes the transistors Tr1 and the transistors Tr2, it is possible to output the drive current when the upstream side transistor Tr1 is turned ON. Therefore, ineffective current does not flow in the output side unit circuit 5*c* of the output stage current mirror circuit 2*b* so long as the transistors Tr1 thereof are in OFF states. In this case, the transistors Tr1 and Tr2 of the unit circuit 5*a* of the drive circuit 2*a* are turned ON simultaneously therewith. However, since the drive current is outputted at this ON timing and then the transistors Tr1 and Tr2 are turned OFF, substantially no ineffective drive current such as leak current flows.

Although the organic EL element drive circuit and the organic EL display device according to the described embodiment is constructed with the P channel MOS FETs mainly, the P channel transistors may be replaced by N channel transistors. In such case, the power source voltage should be negative and the upstream side transistors should be provided on the downstream side.

What is claimed is:

1. An organic EL element drive circuit for current-driving any one of organic EL elements of an organic EL display panel by an output current supplied from a current output circuit constructed with a current-mirror circuit through a corresponding terminal pin of said organic EL display panel, comprising:

a plurality (n) of unit circuits each including a first MOS transistor of a certain channel type and a second MOS transistor of the same channel type and having a source connected to a drain of said first MOS transistor, where n is an integer equal to or larger than 3, gates of either said first MOS transistors or said second MOS transistors of at least two of said n unit circuits being connected to each other to form a common gate, one of said at least two unit circuits constituting an input side circuit of said current mirror circuit, the other of said at least two unit circuit constituting an output side of said current mirror circuit, said common gate being connected to a current drive side terminal of said input side circuit through one of said first MOS transistor and said second MOS transistor of at least one of the remaining unit circuits.

2. The organic EL element drive circuit as claimed in claim 1, wherein said one MOS transistor for connecting said common gate to said current drive side terminal connects said common gate to said current drive side terminal through a source-drain thereof by turning said one MOS transistor and the other of said first and second MOS transistors ON to thereby generate an output drive current to be supplied to said terminal pin.

3. The organic EL element drive circuit as claimed in claim 2, wherein a gate of said the other of said first and second MOS transistors of said input side circuit is connected to a predetermined bias voltage to set an impedance of said the other MOS transistor to a predetermined value and gates of said first and second MOS transistors of said at least one of said remaining unit circuits are connected to a predetermined control line to ON/OFF control said first and second MOS transistors of said one remaining unit circuit correspondingly to a control signal supplied to said control line.

4. The organic EL element drive circuit as claimed in claim 3, wherein said first and second MOS transistors of each of said n unit circuits are P channel transistors and said output side circuit includes a plurality (m) of unit circuits connected in parallel, where m is an integer equal to or larger than 2.

5. The organic EL element drive circuit as claimed in claim 4, further comprising a peak current generator circuit composed of unit circuit identical to each of said unit circuits and connected in parallel to said output side circuit, wherein a peak current is generated by ON/OFF controlling one of a first MOS transistor and a second MOS transistor of said one unit circuit of said peak current generator circuit according to a second control signal supplied to a gate of said first P channel MOS transistor.

6. The organic EL element drive circuit as claimed in claim 5, further comprising a D/A converter circuit for generating a drive current corresponding to a display data, wherein said predetermined bias voltage is ground potential and said peak current generator circuit is constructed with a plurality of parallel-connected unit circuits and supplies said drive current to said current drive side terminal by turning said the other MOS transistor of said the other unit circuit ON.

7. The organic EL element drive circuit as claimed in claim 1, further comprising a capacitor provided between said common gates and a power source line, wherein, after said capacitor is charged with a predetermined voltage by turning said one MOS transistor of said the other unit circuit ON, said output drive current is generated by turning the other of said MOS transistors of said output side circuit ON.

8. The organic EL element drive circuit as claimed in claim 7, further comprising a D/A converter circuit for generating a drive current corresponding to a display data, wherein said output side circuit is constructed with a plurality of said unit circuits connected in parallel to each other and supplies the drive current to said current drive side terminal by turning the other MOS transistor of said output circuit ON.

9. An organic EL display device comprising an organic EL element drive circuit for current-driving any one of organic EL elements of an organic EL display panel by an output current supplied from a current output circuit constructed with a current-mirror circuit through a corresponding terminal pin of said organic EL display panel, said organic EL element drive circuit comprising:

a plurality (n) of unit circuits each including a first MOS transistor of a certain channel type and a second MOS transistor of the same channel type and having a source connected to a drain of said first MOS transistor, where n is an integer equal to or larger than 3, gates of ones of said first MOS transistors and said second MOS transistors of at least two of said n unit circuits being connected to each other to form a common gate, one of said at least two unit circuits constituting an input side circuit of said current mirror circuit, the other of said at least two unit circuit constituting an output side of said current mirror circuit, said common gate being connected to a current drive side terminal of said input side circuit through one of said first MOS transistor and said second MOS transistor of at least one of the remaining unit circuits, an output drive current for said terminal pin being generated by turning said one MOS transistor of said one remaining unit circuit and said the other MOS transistor of said output side circuit ON.

10. The organic EL display device as claimed in claim 9, wherein a gate of said the other of said first and second MOS transistors of said input side circuit is connected to a predetermined bias voltage to set an impedance of said the other MOS transistor to a predetermined value and gates of said first and second MOS transistors of said remaining unit circuits are connected to a predetermined control line to ON/OFF control said first and second MOS transistors of said remaining unit circuits correspondingly to a control signal supplied to said control line.

11. The organic EL display device as claimed in claim 9, further comprising a capacitor provided between said common gate and a power source line, wherein, after said capacitor is charged to a predetermined voltage by turning said one MOS transistor of said the other unit circuit ON, said output drive current is generated by turning the other of said MOS transistors of said output side circuit.

12. The organic EL display device as claimed in claim 11, further comprising a D/A converter circuit for generating a drive current corresponding to a display data, wherein said predetermined bias voltage is ground potential and said output side circuit is constructed with a plurality of said unit circuits connected in parallel to each other and supplies the drive current to said current drive side terminal by turning the other unit circuit of said remaining unit circuits ON.

* * * * *